US011008727B2

(12) United States Patent
Daum et al.

(10) Patent No.: US 11,008,727 B2
(45) Date of Patent: May 18, 2021

(54) OFFSHORE STRUCTURE

(71) Applicant: innogy SE, Essen (DE)

(72) Inventors: Karlheinz Daum, Maxdorf (DE); Daniel Bartminn, Elmshorn (DE); Claus Linnemann, Essen (DE); Colin Billington, Maidenhead (GB)

(73) Assignee: INNOGY SE, Essen (DE)

( * ) Notice: Subject to any disclaimer, the term of this patent is extended or adjusted under 35 U.S.C. 154(b) by 0 days.

(21) Appl. No.: 16/628,148

(22) PCT Filed: Jul. 19, 2018

(86) PCT No.: PCT/EP2018/069664
§ 371 (c)(1),
(2) Date: Jan. 2, 2020

(87) PCT Pub. No.: WO2019/029973
PCT Pub. Date: Feb. 14, 2019

(65) Prior Publication Data

US 2020/0173133 A1 Jun. 4, 2020

(30) Foreign Application Priority Data

Aug. 11, 2017 (DE) ..... 10 2017 118 375.2

(51) Int. Cl.
*E02B 17/02* (2006.01)
*E02D 27/52* (2006.01)
(Continued)

(52) U.S. Cl.
CPC ..... *E02D 27/525* (2013.01); *B63B 35/44* (2013.01); *B63B 73/00* (2020.01);
(Continued)

(58) Field of Classification Search
CPC ..... E02B 17/0008; E02B 2017/0043; E02B 2017/0056; E02B 2017/0073; E02B 17/02; E02D 27/52; E02D 27/525
(Continued)

(56) References Cited

U.S. PATENT DOCUMENTS 4,422,805 A * 12/1983 Sweatman ..... E02B 17/0008 405/222
4,552,486 A * 11/1985 Knox ..... E02B 17/0008 405/225
(Continued)

FOREIGN PATENT DOCUMENTS

DE 10330963 1/2005
DE 102012020871 4/2014
(Continued)

OTHER PUBLICATIONS

English translation of International Report on Patentability from corresponding PCT Appln. No. PCT/EP2018/069664, dated Aug. 6, 2019.
(Continued)

*Primary Examiner* — Frederick L Lagman
(74) *Attorney, Agent, or Firm* — Grossman, Tucker, Perreault & Pfleger, PLLC

(57) ABSTRACT

An offshore structure having a foundation structure, wherein the foundation structure has at least a first and a second profile, the first profile is designed as a pile and the second profile is designed as a pile sleeve, the second profile encloses the first profile over a penetration length, wherein an interspace is formed between the first and the second profile, the interspace has a casting compound filling over the total penetration length, shear elements are provided on the first and/or the second profile, the shear elements extend into the interspace and effect an axial load dissipation into the casting compound filling, the shear elements are pro-
(Continued)

vided only over a first partial length of the penetration length, the first partial length is between 65 and 90% of the total penetration length and a second partial length is free of shear elements, wherein the second partial length forms the upper length of the penetration length in the installed position.

11 Claims, 5 Drawing Sheets

(51) Int. Cl.

| | |
|---|---|
| ***B63B 73/00*** | (2020.01) |
| ***B63B 35/44*** | (2006.01) |
| ***E02B 17/00*** | (2006.01) |
| ***E02D 5/30*** | (2006.01) |
| ***E02D 5/48*** | (2006.01) |
| *E02D 27/42* | (2006.01) |

(52) U.S. Cl.
CPC ..... *E02B 17/0008* (2013.01); *E02B 17/02* (2013.01); *E02B 17/027* (2013.01); *E02D 5/30* (2013.01); *E02D 5/48* (2013.01); *E02B 2017/0043* (2013.01); *E02B 2017/0065* (2013.01); *E02B 2017/0091* (2013.01); *E02D 27/425* (2013.01); *E02D 2200/1685* (2013.01); *E02D 2250/0023* (2013.01); *E02D 2300/0001* (2013.01); *E02D 2300/002* (2013.01); *E02D 2300/0006* (2013.01); *E02D 2300/0029* (2013.01); *E02D 2300/0051* (2013.01); *E02D 2600/00* (2013.01)

(58) Field of Classification Search
USPC ..... 405/227
See application file for complete search history.

(56) References Cited

U.S. PATENT DOCUMENTS 5,028,171 A * 7/1991 Gray ..... E02B 17/0008 405/225
5,226,751 A * 7/1993 Doleshal ..... E02D 5/60 405/211.1
5,445,476 A * 8/1995 Sgouros ..... E02B 17/00 285/382.4
5,743,677 A * 4/1998 Phillips ..... E02B 17/0008 405/199
6,593,280 B2 * 7/2003 Matsunaga ..... E02D 31/10 508/100
8,757,933 B2 * 6/2014 Li ..... E02B 17/0008 405/227
9,587,365 B2 3/2017 Seidel
10,508,399 B1 * 12/2019 Lee ..... F16J 15/46
2006/0185279 A1 8/2006 Eusterbarkey
2015/0082720 A1 * 3/2015 Rodriguez Tsouroukdissian ..... E02B 17/027 52/298
2015/0368871 A1 * 12/2015 Seidel ..... E02D 27/425 405/222
2016/0002874 A1 * 1/2016 Schultes ..... E02D 5/50 405/233
2018/0320335 A1 * 11/2018 Jeon ..... E02D 27/425

FOREIGN PATENT DOCUMENTS

| | | | | |
|---|---|---|---|---|
| DE | 202015002656 | | 5/2015 | |
| EP | 2559814 | | 2/2013 | |
| EP | 2669437 | | 12/2013 | |
| EP | 2698476 | A1 * | 2/2014 | ..... E02D 27/425 |
| EP | 3597829 | A1 * | 1/2020 | ..... E02D 27/52 |
| WO | 2011/010937 | | 1/2011 | |
| WO | WO-2017129514 | A1 * | 8/2017 | ..... C02F 1/283 |

OTHER PUBLICATIONS

English translation of International Search Report from corresponding PCT Appln. No. PCT/EP2018/069664, dated Oct. 15, 2018.

* cited by examiner

OFFSHORE STRUCTURE

FIELD

The invention relates to an offshore structure having a foundation structure, wherein the foundation structure has at least a first and a second profile, the first profile is designed as a pile and the second profile is designed as a pile sleeve, the second profile encloses the first profile over a penetration length, wherein an interspace is formed between the first and the second profile, the interspace has a casting compound filling over the total penetration length, shear elements are provided on the first and/or the second profile and the shear elements extend into the interspace and effect an axial load dissipation into the casting compound filling.

BACKGROUND

The invention relates in particular to a cast connection on an offshore structure. Such a cast connection is referred to in the technical jargon as a so-called "grouted joint". Grouted joints are construction elements which are crucial for the structural integrity of offshore constructions and which usually constitute the single connection between a foundation structure or a foundation and a supporting structure. In the case of so-called monopile foundations, for example, such connections are found between the monopile and a transition piece. Moreover, grouted joints are found, for example, in jacket foundations which comprise piles and pile sleeves as profiles. It is particularly in the founding of offshore wind turbines that casting compound connections of the type stated at the outset play a key role.

These connections customarily comprise two cylindrical steel tubes of different diameter which are connected to one another by a casting mortar. The tube having the smaller diameter is generally referred to as a pile, whereas the larger, enclosing tube is referred to as a pile sleeve or sleeve. The interspace remaining between the pile and the sleeve is filled with a casting mortar or a casting compound, which is also referred to as grout in the technical jargon. Casting compound connections or cast connections of this type serve primarily to dissipate axial loads of the structure into the seabed. The compressive strength of the casting compound after curing thereof is crucial for the load-bearing behaviour of cast connections.

A significant increase in the load-bearing strength of cast connections is achieved in the prior art by the use of shear ribs, which moreover also allow a reduction of the required casting length or penetration length. Shear ribs are ribs, projections, webs or the like which are fastened to the mutually facing sides of the profiles and which project into the interspace between the profiles such that they are enclosed by the casting compound. The use of shear ribs means that axial loads are dissipated into the casting mortar via the contact surfaces. The size of the shear-transferring contact surfaces is thereby increased.

In the prior art, a distinction is made in principle between cast connections with and without shear ribs, with the use of shear ribs having been found to be advantageous. Investigations on the load-bearing capacity of cast connections (see for example the dissertation "Betontechnologische Einflüsse auf das Tragverhalten von Grouted Joints" ["Concrete technology influences on the load-bearing behaviour of grouted joints"] ISBN 978-3-936634-05-1) result in the finding that, for the load-bearing capacity of cast connections, the compressive strength and stiffness of the casting mortar, the geometry of the steel tubes and of the cast interspace, the surface accuracy of the steel tubes, in particular the height and the spacing of the shear ribs, and the casting length of the profiles or steel tubes play a role.

In practice, it has been shown that failure of cast connections occurs in spite of optimizing the casting length, the geometry of the shear ribs and further measures.

SUMMARY

The object on which the invention is based is therefore to provide an offshore structure or a cast connection on an offshore structure which is improved in terms of the load-bearing and failure behaviour.

One aspect of the invention relates to an offshore structure having a foundation structure, wherein the foundation structure has at least a first and a second profile, the first profile is designed as a pile and the second profile is designed as a pile sleeve, the second profile encloses the first profile over a penetration length, wherein an interspace is formed between the first and the second profile, the interspace has a casting compound filling over the total penetration length, shear elements, for example in the form of shear ribs or the like, are provided on the first and/or the second profile, the shear elements extend into the interspace and effect an axial load dissipation into the casting compound filling, wherein the shear elements are provided only over a first partial length of the penetration length, wherein the first partial length is between 65 and 90% of the total penetration length and a second partial length is free of shear elements, wherein the second partial length forms the upper length of the penetration length in the installed position.

The applicant has observed in tests that a key cause for the failure or fatigue of cast connections lies in compression lines which form diagonally in the casting compound, said lines leading to crack formation in the casting compound and, in particular in the upper part of the casting length or the penetration length, resulting in the casting compound escaping from the region of the enclosure of the profiles. The first loss of casting compound from the enclosure leads to a significant reduction in the load-bearing capacity, which can ultimately lead to the failure of the cast connection.

These diagonally forming compression lines preferably generate corresponding reaction forces on the underside of shear elements, with the result that it has been found in a surprising manner to be particularly advantageous to provide the shear elements only over a partial length of the penetration length, and in particular to keep free of shear elements that region of the penetration length or of the casting length which is situated at the top in the installed position of the profiles. This advantageously prevents a loss of casting compound or an oozing-out or pushing-out of the casting compound from the enclosure of the profiles, with the result that the load-bearing strength of the cast connection is significantly improved.

It has proved to be particularly advantageous to have a configuration of the cast connection or of the offshore structure in which the second partial length has a length which is between one and two times the width of the interspace. The interspace between the profiles can be for example approximately 500 mm wide. The diameter of the second profile can be for example approximately 2.5 to 3 m.

The casting compound provided is for example a hydraulically setting casting compound, for example a high-strength concrete.

The profiles preferably take the form of cylindrical steel tubes, with one steel tube being designed as a pile and the other steel tube being designed as a sleeve. The profiles can be part of a connection between the monopile and transition piece of an offshore structure.

The profiles can alternatively be part of the foundation of an offshore structure having a jacket.

In an advantageous variant of the offshore structure according to the invention, there is provision that the first profile and/or the second profile have/has an adhesion-reducing coating over the second partial length on the side facing the interspace. It can thereby be ensured that the shear stresses resulting from a relative movement of the profiles with respect to one another are introduced into the casting compound only over the first partial length of the penetration length or only over a first partial length of the casting length. It is ensured in this way that a casting compound plug remains in the upper region of the cast connection, the integrity of which plug is not adversely affected by shear stresses introduced into the casting compound.

Tests conducted by the applicant have shown that cracks in the casting compound rarely play a role for the load-bearing capacity of the cast connection if these cracks occur only in the first partial length of the penetration length or in the first partial length of the casting length. The plug then reliably prevents an escape of the casting compound from the enclosed region of the profiles or from the interspace between the profiles.

The adhesion-reducing coating can preferably be provided either on the inner side of the second profile that faces the interspace or on the outer side of the first profile that faces the interspace, depending on which profile is exposed to compressive and tensile loading in the axial direction. In the case of a jacket, for example, this can depend on whether the jacket has been fastened by pre-piling or by post-piling.

For example, there can be provision that a layer of an elastic material, preferably of an expanded thermoplastic, is provided between the first profile and/or the second profile and the casting compound filling over the second partial length of the penetration length or of the casting length.

The casting compound filling can comprise a first casting compound over the first partial length of the penetration length and a second casting compound over the second partial length of the penetration length, wherein the second casting compound has a higher tensile and/or compressive strength than the first casting compound. For example, the second casting compound can be fibre-reinforced or strengthened. For example, the second casting compound can take the form of fibre concrete.

There is expediently provision that the second casting compound has a higher ductility than the first casting compound.

In principle, there can be provision that the casting compound filling receives an insert component over the second partial length that is selected from a group of insert components comprising prefabricated concrete elements, steel profiles and polymer construction materials, wherein the insert component has a higher tensile and/or compressive strength than the casting compound.

It has been found to be particularly advantageous to have a configuration of the cast connection on the offshore structure in which the interspace is at least partially closed on the upper end side in the installed position. For this purpose, there can be provision that the pile sleeve has an upper, inwardly projecting collar which partially covers an upper end side of the interspace in the installed position and thus prevents an escape or oozing-out for instance of brittle casting compound.

Alternatively, there can be provision that the pile has a collar or flange which closes the interspace on the end side.

Alternatively or in addition, there can be provision that the first profile or the second profile has fastened thereto a reinforcement which extends over the second partial length of the penetration length. The reinforcement is expediently provided on that profile which is not exposed to alternating tensile and compressive loading.

BRIEF DESCRIPTION OF THE DRAWINGS

The invention is described below with reference to an exemplary embodiment illustrated in the drawings, in which.

DETAILED DESCRIPTION

Figure 1:
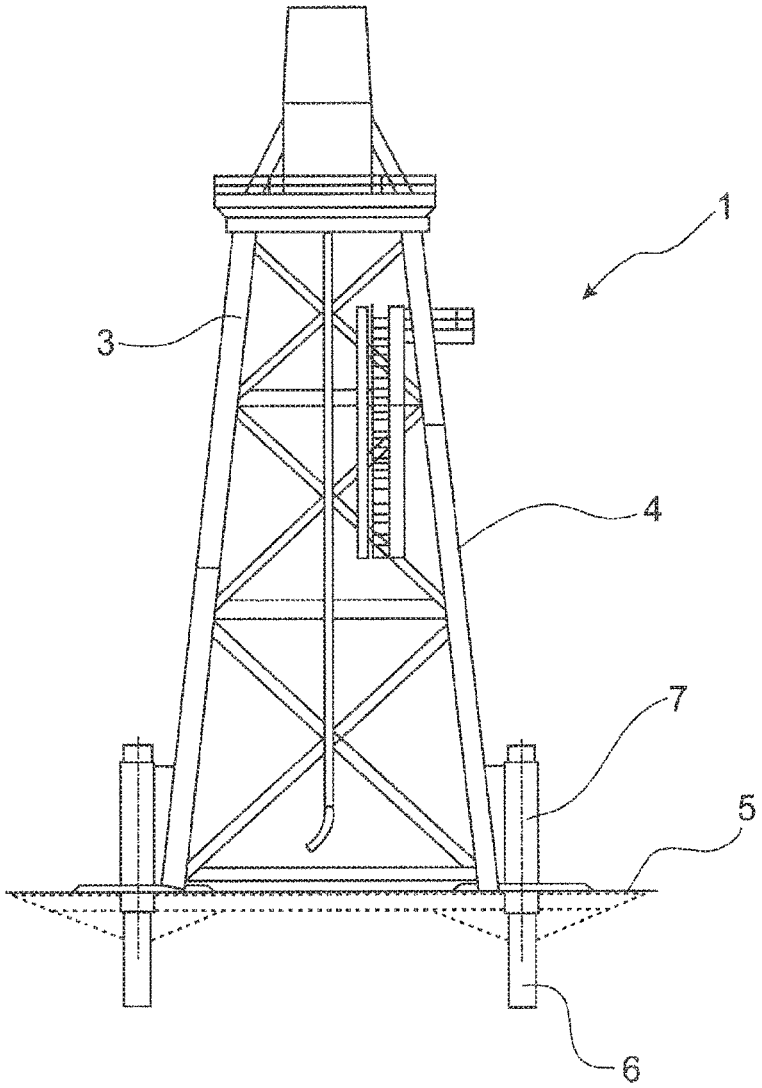
FIG. 1 shows a schematic illustration of a part of an offshore wind turbine having cast connections which have been created according to the principle of post-piling.

The invention relates to an offshore structure 1 and in particular to a cast connection on an offshore structure 1. The invention is described below with reference to an offshore structure 1 having a jacket foundation. As has already been mentioned at the outset, the principle of the cast connection according to the invention can be applied to different types of connections on offshore structures.

The offshore structure 1 comprises for example a tower structure 2, a transition piece 3, a so-called jacket 4 and an anchoring of the jacket 4 in the seabed 5 in the form of piles 6 and pile sleeves 7.

The offshore structure 1 illustrated in FIG. 1 has been founded by so-called pre-piling, i.e. the piles 6 have been driven into the seabed 5 using a template and a corresponding tool. The piles sleeves 7, which are fastened to the jacket 4, have been placed on the driven-in piles 6, with the latter penetrating the pile sleeves 7. A curable casting compound 11, for example a fibre concrete or the like, has been cast into an interspace 8 or annular space between the piles 6 and the pile sleeves 7.

Figure 2:
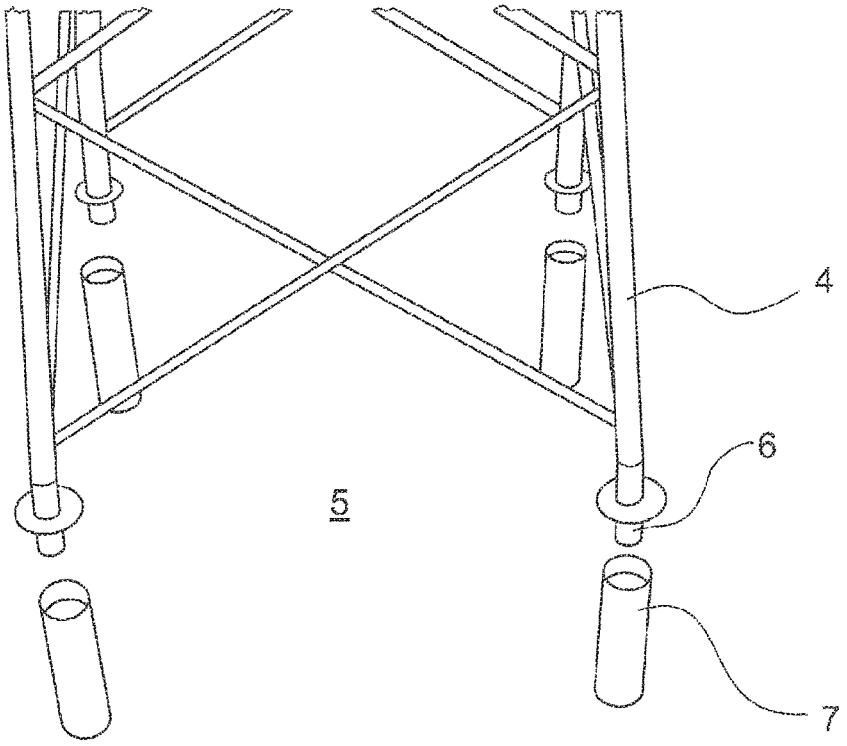
FIG. 2 shows a schematic illustration of an offshore wind turbine having cast connections which have been created according to the principle of pre-piling.

Another variant of the pile foundation is illustrated in FIG. 2. This variant of the foundation is generally referred to as post-piling. Here, the pile sleeves 7 are first driven into the seabed 5. The feet of the jacket, which are each designed as piles 6, are inserted into said sleeves. The interspace between the pile 6 and the pile sleeve 7 is likewise filled with a curable casting compound.

The axial forces introduced into the seabed via the jacket 4 are dissipated into the piles 6 (FIG. 1) or into the pile sleeves 7 (FIG. 2) via the casting compound.

Figure 3A:
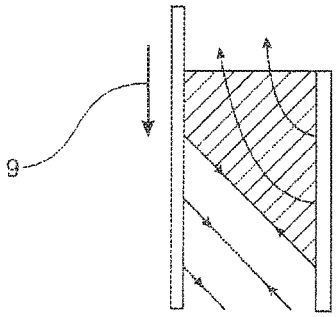
FIG. 3*a* shows a partial section through a cast connection of the foundation of the offshore wind turbine represented in FIG. 2, which schematically illustrates a shear stress as compressive stress of the cast connection.
Figure 3B:
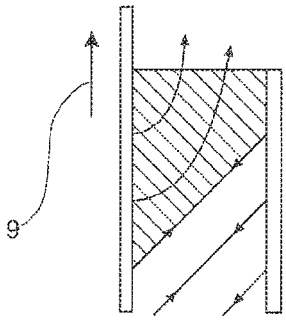
FIG. 3*b* shows a partial section through a cast connection of the foundation of the offshore wind turbine represented in FIG. 2, which schematically illustrates a shear stress as tensile stress of the cast connection.

FIGS. 3*a* and 3*b* show the typical loading of the casting compound 11 with the introduction of tensile or compressive forces for example via the pile 6 in a foundation, as is shown in FIG. 2. The loading direction is indicated by the arrows 9 depicted in FIGS. 3*a* and 3*b*.

In FIG. 3*a*, the inner profile is a cylindrical pile 6, whereas the outer profile, which encloses the inner profile, forms the pile sleeve 7. The interspace 8 is filled with a casting mortar or a hydraulically setting casting compound 11. With the introduction of compressive forces as shear stress, as illustrated for example in FIG. 3*a*, there appear diagonal compression lines 10 between the pile 6 and the pile sleeve 7 which under certain circumstances have the effect that the casting compound 11 is pressed out upwardly from the interspace 8. The movement tendency of the casting compound 11 is indicated by the arrows 13.

The applicant has observed that in particular the interaction of the compression lines 10 with the underside of shear ribs 12 or shear elements of some other design generates oppositely diagonally extending reaction forces which result in the casting compound 11 becoming brittle and being driven upwardly out of the interspace 8, as is indicated by the arrows 13. In particular, the loss of the casting compound 11 escaping from the enclosure of the profiles ultimately causes a failure of the cast connection. FIG. 3*a* shows the loading profile with introduction of axial compressive forces, whereas FIG. 3*b* illustrates the loading profile with introduction of axial tensile forces.

Figure 4:
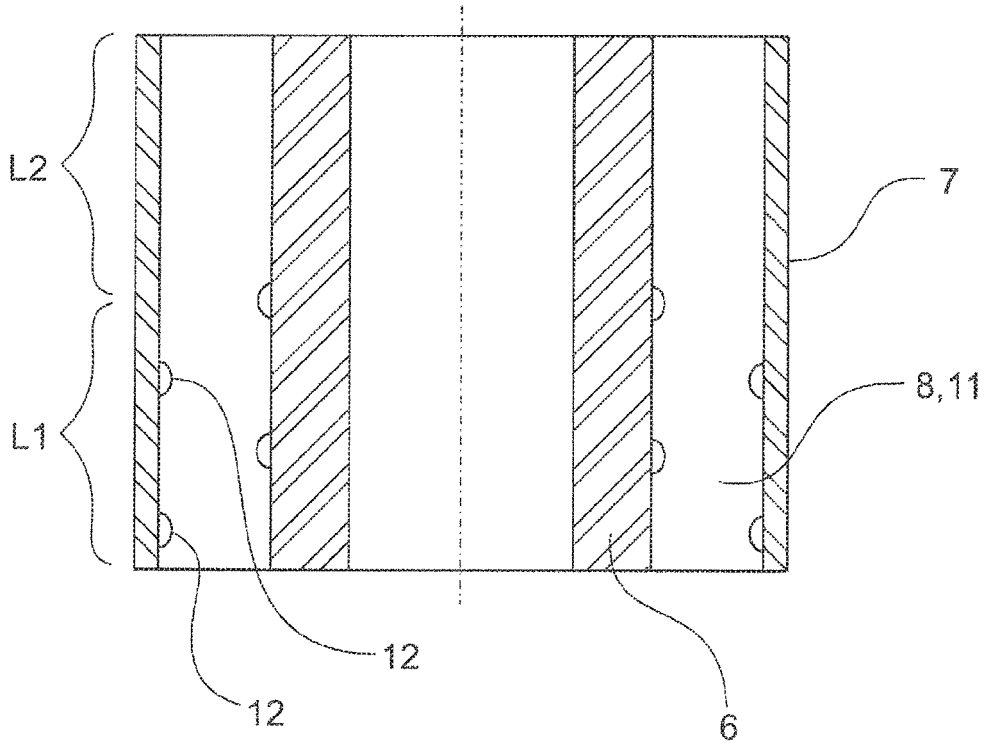
FIG. 4 shows a section through a cast connection according to the invention, which shows the arrangement of the shear elements.
Figure 5:
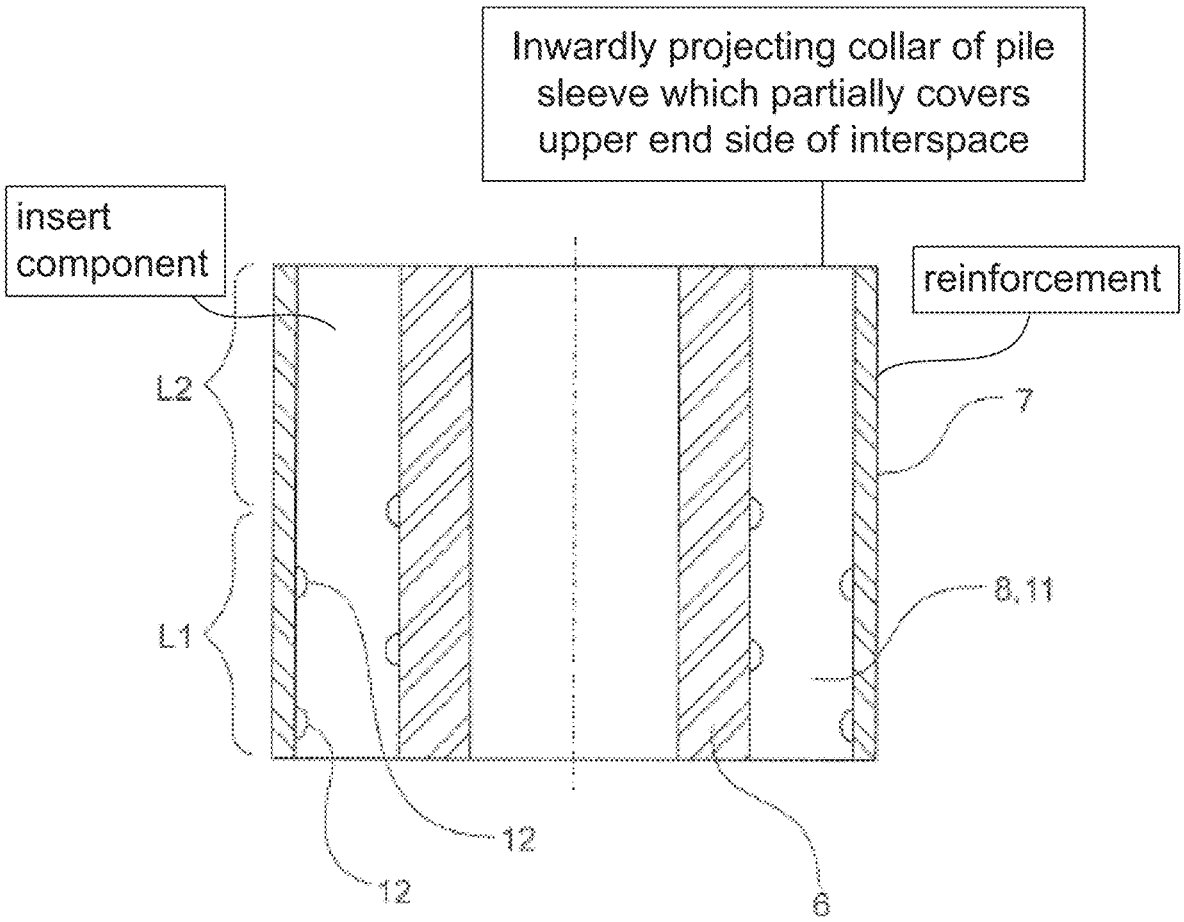
FIG. 5 shows the section through the case connection of FIG. 4, further including certain additional features as illustrated.

FIG. 4 shows a partial longitudinal section through a cast connection according to the invention. The formation of the cast connection (grouted joint) in the form of two cylindrical steel profiles as pile 6 and pile sleeve 7 which penetrate one another corresponds to the configuration according to FIGS. 3*a* and 3*b*. The pile 6 and the pile sleeve 7 penetrate one another over a penetration length $L_{total}$, which corresponds to the casting length or the height of the casting compound 11 situated in the interspace 8. The penetration length $L_{total}$ is subdivided into a first partial length L1 and into a second partial length L2, with the second partial length L2 being the upper partial length in the installed position of the pile sleeve 7 and the first partial length L1 forming the lower partial length.

Shear elements, for example in the form of shear ribs 12 or other geometries, which project into the interspace 8 and are enclosed by the casting compound 11, extend over the first partial length L1 of the penetration length on the side of the pile sleeve 7 that faces the interspace 8 and on the outer side of the pile 6 that faces the interspace 8. According to the invention, the partial length L2 of the penetration length is free of shear elements. The shear ribs 12 are provided only in the region of the first partial length L1 of the penetration length. The height of the second partial length L2 corresponds approximately to one to two times the width of the interspace 8 (0.5×(inside diameter of pile sleeve minus outside diameter of pile)).

LIST OF REFERENCE SIGNS

1 Offshore structure
2 Tower structure
3 Transition piece
4 Jacket
5 Seabed
6 Pile
7 Pile sleeves
8 Interspace
9 Arrows
10 Compression lines
11 Casting compound
12 Shear ribs
13 Arrows
L1 First partial length
L2 Second partial length
$L_{total}$=L1+L2

The invention claimed is:

1. An offshore structure comprising:

a foundation structure, wherein the foundation structure has at least a first and a second profile, wherein the first profile is configured as a pile and the second profile is configured as a pile sleeve, and the second profile encloses the first profile over a penetration length, wherein an interspace is formed between the first profile and the second profile, the interspace has a casting compound filling over the penetration length, wherein shear elements are provided on the first profile and/or the second profile, the shear elements extend into the interspace and effect an axial load dissipation into the casting compound filling, the shear elements are provided only over a first partial length of the penetration length, the first partial length is between 65% and 90% of the penetration length and a second partial length is free of shear elements, wherein the second partial length forms an upper length of the penetration length in an installed position, wherein (a) the first profile and/or the second profile have/has an adhesion-reducing coating over the second partial length on a side facing the interspace; and/or (b) a layer of an elastic material is provided between first profile and/or the second profile and the casting compound filling over the second partial length of the penetration length.

2. The offshore structure according to claim 1, wherein the second partial length has a length which is at least equal to a width of the interspace.

3. The offshore structure according to claim 1, wherein the casting compound filling comprises a first casting compound over the first partial length of the penetration length and a second casting compound over the second partial length of the penetration length, and the second casting compound has a higher tensile and/or a higher compressive strength than the first casting compound.

4. The offshore structure according to claim 3, wherein the second casting compound has a higher ductility than the first casting compound.

5. The offshore structure according to claim 1, wherein the casting compound filling is fibre-reinforced and/or strengthened over the second partial length of the penetration length.

6. The offshore structure according to claim 1, wherein the casting compound filling receives an insert component over the second partial length, wherein the insert component has a higher tensile and/or a higher compressive strength than the casting compound.

7. The offshore structure according to claim 6, wherein the insert component is selected from a group of insert components comprising prefabricated concrete elements, steel profiles and polymer construction materials.

8. The offshore structure according to claim 1, wherein the interspace is at least partially closed on an upper end side in the installed position.

9. The offshore structure according to claim 1, wherein the pile sleeve has an upper, inwardly projecting collar which partially covers an upper end side of the interspace in the installed position.

10. The offshore structure according to claim 1, in which the first profile or the second profile has fastened thereto a reinforcement which extends over the second partial length of the penetration length.

11. The offshore structure according to claim 1, wherein the shear elements are selected from a group comprising shear ribs and/or shear webs.

* * * * *